US007614726B2

(12) United States Patent
Yamaguchi et al.

(10) Patent No.: US 7,614,726 B2
(45) Date of Patent: Nov. 10, 2009

(54) RECORDING HEAD CHIP, RECORDING HEAD EMPLOYING RECORDING HEAD CHIP, AND RECORDING APPARATUS EMPLOYING RECORDING HEAD

(75) Inventors: Takaaki Yamaguchi, Yokohama (JP); Yoshiyuki Imanaka, Kawasaki (JP); Takuya Hatsui, Tokyo (JP); Souta Takeuchi, Yokohama (JP); Takahiro Matsui, Koganei (JP); Kousuke Kubo, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 402 days.

(21) Appl. No.: 11/612,252

(22) Filed: Dec. 18, 2006

(65) Prior Publication Data

US 2007/0139480 A1 Jun. 21, 2007

(30) Foreign Application Priority Data

Dec. 19, 2005 (JP) ..... 2005-365424

(51) Int. Cl.
*B41J 2/14* (2006.01)

(52) U.S. Cl. ..... 347/58; 347/59; 347/40; 347/41

(58) Field of Classification Search ..... 347/58
See application file for complete search history.

(56) References Cited

U.S. PATENT DOCUMENTS

| | | | | |
|---|---|---|---|---|
| 4,216,481 | A * | 8/1980 | Hakoyama | 347/182 |
| 4,723,129 | A | 2/1988 | Endo et al. | 346/1.1 |
| 6,474,788 | B1 | 11/2002 | Saito et al. | 347/58 |
| 7,165,823 | B2 * | 1/2007 | Yakura et al. | 347/12 |
| 7,255,426 | B2 | 8/2007 | Ibe et al. | 347/58 |
| 2005/0134620 | A1 * | 6/2005 | Hirayama et al. | 347/9 |
| 2006/0125881 | A1 | 6/2006 | Kubo et al. | 347/59 |
| 2006/0232633 | A1 | 10/2006 | Kubo et al. | 347/58 |
| 2007/0206061 | A1 | 9/2007 | Ibe et al. | 347/55 |

* cited by examiner

*Primary Examiner*—Matthew Luu
*Assistant Examiner*—Brian J Goldberg
(74) *Attorney, Agent, or Firm*—Fitzpatrick, Cella, Harper & Scinto

(57) ABSTRACT

A recording head substrate includes a plurality of groups of recording elements arranged in arrays; a number, corresponding to a number of the groups, input contacts for receiving driving pulse signals; signal lines for supplying the driving pulse signals to the groups of recording elements from the input contacts, respectively, wherein in a region between two of the groups of recording elements are adjacent to each other, the signal lines are connected to the recording elements such that areas in which the groups of recording elements are disposed, respectively, have respective driving pulse signal change areas which are overlapped with each other.

5 Claims, 13 Drawing Sheets

(a)

| HE ＊ HE1 | HE2 | Seg.No | Seg.No | HE ＊ HE1 | HE2 |
|---|---|---|---|---|---|
| H | x | 0 | 1 | H | x |
| H | x | 2 | 3 | H | x |
| H | x | 4 | 5 | H | x |
| H | x | 6 | 7 | H | x |
| H | x | 8 | 9 | H | x |
| H | x | 10 | 11 | H | x |
| H | x | 12 | 13 | H | x |
| H | x | 14 | 15 | H | x |
| x | H | 16 | 17 | x | H |
| x | H | 18 | 19 | x | H |
| H | x | 20 | 21 | H | x |
| H | x | 22 | 23 | H | x |
| x | H | 24 | 25 | x | H |
| x | H | 26 | 27 | x | H |
| x | H | 28 | 29 | x | H |
| x | H | 30 | 31 | x | H |
| x | H | 32 | 33 | x | H |
| x | H | 34 | 35 | x | H |
| x | H | 36 | 37 | x | H |
| x | H | 38 | 39 | x | H |

(b)

| HE＊ HE1 | HE2 | Seg.No | Seg.No | HE＊ HE1 | HE2 |
|---|---|---|---|---|---|
| H | x | 0 | 1 | H | x |
| H | x | 2 | 3 | H | x |
| H | x | 4 | 5 | H | x |
| H | x | 6 | 7 | H | x |
| H | x | 8 | 9 | H | x |
| x | H | 10 | 11 | x | H |
| H | x | 12 | 13 | H | x |
| x | H | 14 | 15 | x | H |
| H | x | 16 | 17 | H | x |
| x | H | 18 | 19 | x | H |
| H | x | 20 | 21 | H | x |
| x | H | 22 | 23 | x | H |
| H | x | 24 | 25 | H | x |
| x | H | 26 | 27 | x | H |
| H | x | 28 | 29 | H | x |
| x | H | 30 | 31 | x | H |
| x | H | 32 | 33 | x | H |
| x | H | 34 | 35 | x | H |
| x | H | 36 | 37 | x | H |
| x | H | 38 | 39 | x | H |

(c)

| HE＊ HE1 | HE2 | HE3 | HE4 | Seg.No | Seg.No | HE＊ HE1 | HE2 | HE3 | HE4 |
|---|---|---|---|---|---|---|---|---|---|
| H | x | x | x | 0 | 1 | H | x | x | x |
| H | x | x | x | 2 | 3 | H | x | x | x |
| H | x | x | x | 4 | 5 | H | x | x | x |
| H | x | x | x | 6 | 7 | H | x | x | x |
| x | H | x | x | 8 | 9 | x | H | x | x |
| H | x | x | x | 10 | 11 | H | x | x | x |
| x | H | x | x | 12 | 13 | x | H | x | x |
| x | H | x | x | 14 | 15 | x | H | x | x |
| x | H | x | x | 16 | 17 | x | H | x | x |
| x | x | H | x | 18 | 19 | x | x | H | x |
| x | H | x | x | 20 | 21 | x | H | x | x |
| x | x | H | x | 22 | 23 | x | x | H | x |
| x | x | H | x | 24 | 25 | x | x | H | x |
| x | x | H | x | 26 | 27 | x | x | H | x |
| x | x | x | H | 28 | 29 | x | x | x | H |
| x | x | H | x | 30 | 31 | x | x | H | x |
| x | x | x | H | 32 | 33 | x | x | x | H |
| x | x | x | H | 34 | 35 | x | x | x | H |
| x | x | x | H | 36 | 37 | x | x | x | H |
| x | x | x | H | 38 | 39 | x | x | x | H |

FIG.9

| RANKING OF RESISTANCES OR THRESHOLD | RANK NO. |
|---|---|
| R1 ≤R≤ R2 | 1 |
| R2 ≤R≤ R3 | 2 |
| ⋮ | ⋮ |
| R(n-2) ≤R≤ R(n-1) | N-1 |
| R(n-1) ≤R≤ R2 | N |

| HE* | | | | | HE* | |
|---|---|---|---|---|---|---|
| HE1 | HE2 | Seg.No | | Seg.No | HE1 | HE2 |
| H | x | 0 | | 1 | H | x |
| H | x | 2 | | 3 | H | x |
| H | x | 4 | | 5 | H | x |
| H | x | 6 | | 7 | H | x |
| H | x | 8 | | 9 | H | x |
| H | x | 10 | | 11 | H | x |
| H | x | 12 | | 13 | H | x |
| H | x | 14 | | 15 | H | x |
| H | x | 16 | | 17 | H | x |
| H | x | 18 | | 19 | H | x |
| x | H | 20 | | 21 | x | H |
| x | H | 22 | | 23 | x | H |
| x | H | 24 | | 25 | x | H |
| x | H | 26 | | 27 | x | H |
| x | H | 28 | | 29 | x | H |
| x | H | 30 | | 31 | x | H |
| x | H | 32 | | 33 | x | H |
| x | H | 34 | | 35 | x | H |
| x | H | 36 | | 37 | x | H |
| x | H | 38 | | 39 | x | H |

RECORDING HEAD CHIP, RECORDING HEAD EMPLOYING RECORDING HEAD CHIP, AND RECORDING APPARATUS EMPLOYING RECORDING HEAD

FIELD OF THE INVENTION AND RELATED ART

The present invention relates to a recording head chip, a recording head which uses a recording head chip, and a recording apparatus which uses a recording head. In particular, it relates to a recording head chip used for an ink jet recording method, a recording head which uses such a chip, and a recording apparatus which uses such as a recording head.

Among various ink jet recording methods, there has been known a recording method such as the one stated in U.S. Pat. No. 4,723,129 (patent document). According to this method, ink is jetted from orifices of the front surface of a recording head portion by utilizing the bubbles generated by applying heat to liquid. Not only is the recording method disclosed in U.S. Pat. No. 4,723,129 very effective for recording, in particular, the so-called drop-on-demand recording, but also, it makes it easier to realize a full-line recording head, which is provided with a large number of orifices arranged at high density to record at high level of resolution, at a high level of image quality, and at a high speed.

A recording head such as the above described one has a liquid jetting portion having multiple orifices for jetting liquid such as ink, and multiple liquid passages which are connected to the orifices. The liquid passages include a heat applying portion for applying heat to liquid. The recording head, that is, the ink jet recording head (which hereafter will be referred to simply as recording head) is provided with a recording head chip which has electro-thermal transducers (heater) for generating thermal energy.

Some of the recent recording heads, such as the one described above, are made up of multiple heaters, multiple heater drivers, a shift register for parallelly sending picture data to the heater drivers, and a latch circuit which temporarily store the data.

FIG. 14 is a block diagram of a recording head chip in accordance with the prior art, showing the circuit design thereof.

Referring to FIG. 14, designated by referential symbol 900 is a recording head chip (which hereafter will be referred to as chip), and designated by a referential symbol 901 is a heater. Designated by a referential symbol 902 is a power transistor which controls the power supply to the heater 901, and designated by a referential symbol 903 is a latch circuit which latches recording data in synchronization with latch clock (L). Designated by a referential symbol 904 is a shift register which inputs serial data (DATA) in synchronization with serial clock (CK), and designated by a referential symbol 914 is a heater resistance value detecting element as a sensor for detecting the resistance value of the heater 901 of the chip 900.

Designated by referential symbols 905-913 are input/output terminals. Among these input/output terminals, the terminal designated by a referential symbol 908 is the terminal through which heat generation pulse signals (heater driving pulse signals) for externally controlling the length of time the power transistor 902 is kept turned on, that is, the length of time the heater 901 is driven by supplying it with electric current, are inputted. Further, designated by a referential symbol 909 is the terminal of the electric power source for driving the logic circuit, and designated by a referential symbol 910 is a ground terminal (GND). Designated by a referential symbol 911 is an input terminal of the electric power source for driving the heater 901.

As the recording data are serially inputted into the recording head chip structured as described above, they are stored in the shift register 904, and are latched by the latch circuit 903 in response to latch signals. With the recording data latched by the latch circuit 903, heat generation pulse signals are inputted through the terminal 908. As a result, the power transistors 902 are selectively turned on in accordance with the recording data. Thus, electric current flows through the selected heaters 901. Consequently, the ink in the liquid passages corresponding to the selected heaters 901 is heated, being thereby jetted in the form of a liquid droplet through the nozzle tips corresponding to the selected heaters 901.

To think of the amount of energy necessary for the heater 902 to cause the liquid to boil, it can be expressed as the product between the amount of the energy which the heater 901 requires per unit area, and the size of the area of the heater 901, provided that the conditions related to heat radiation remains stable. Thus, all that is necessary for causing each heater 901 to cause the body of liquid in contact with the heater 901 to boil is to set the amount of voltage applied between the input and output ends of the heater 901, the amount by which electric current flows through the heater 901, and the length of time (pulse width) voltage is applied, to the values which enable the heater 901 to produce the necessary amount of energy. Here, the voltage applied to the heater can be kept roughly constant by supplying the heater with the voltage from the electric power source of the main assembly of the image forming apparatus.

On the other hand, the amount by which electric current flows through a given heater 901 is different from that which flows through another one, because of the difference in the electrical resistance value between the two heaters. This difference occurs because of the difference between the two heaters in terms of the thickness to which the two heaters are formed in the form of film during the chip manufacture. Thus, the two heaters may be different in the amount of the electric current which flows through them, even if they belong to the same chip. Obviously, the two heaters are more likely to be different in the amount of electric current which flows through them, if they belong to two chips different in lot number. Therefore, even if the width of the heat generation pulse signal applied to one heater is the same as that applied to the other, the amount by which electric current flows through the heater, which is greater in electric resistance value, is smaller than the amount by which electric current flows through the heater, which is smaller in electrical resistance value. Thus, even if the two heaters receive a theoretically proper amount of energy for boiling ink, that is, a heat generation pulse signal which is proper in voltage and width, this amount of energy may be insufficient for causing the heater which is greater in electric resistance value to boil ink. On the contrary, this amount of energy may cause electric current to flow through the heater smaller in electric resistance by an amount greater than a preset one, causing thereby this heater to generate an excessive amount of thermal energy, possibly reducing the service life thereof.

One of the conventional methods which have been proposed, or practiced, for dealing with the above described problem is as follows: The electrical resistance value of a heater 901 is monitored with the use of a rank heater 914, as a heater for ranking heaters, and the results of the monitoring by the rank heater 914 are fed back to the main assembly of an image forming apparatus to control the recording process. Further, the temperature of the chip 900 is monitored by a temperature sensor, and the voltage applied by the electric power source, and the width of a heat generation pulse signal, are varied based on the obtained temperature values of the chip 900 so that the amount of energy which the heater 901 receives remains roughly constant.

In recent years, an ink jet recording apparatus (which hereafter may be referred to simply as recording apparatus) has been rapidly reduced in the size of a liquid ink droplet it jets, in order to achieve a higher level of resolution and improve the apparatus in image quality. Also in recent years, an ink jet recording apparatus has been devised for higher recording speed. Thus, it has become common practice to arrange a large number of small heaters, which corresponds in size to the smaller ink droplet at a very high level of density, on the substrate of a single recording head chip, in order to reduce the recording apparatus in ink droplet size while improving it in recording speed. For example, if an ink jet recording apparatus is simply modified for halving the size of an ink droplet it jets, the recording speed of the apparatus becomes half the recording speed prior to the modification; it takes twice the length of time to form the same image. Thus, in order to prevent the modification from changing the recording apparatus in recording speed, the recording apparatus must be doubled in the number of heaters. Further, along the same line of thought, in order to double an ink jet recording speed in recording speed while halving it in ink droplet size, the recording apparatus must be quadrupled in the number of heaters.

As described above, in order to improve an ink jet recording apparatus in image quality while keeping the apparatus the same, or increasing the apparatus, in recording speed, it cannot be avoided to increase the apparatus in the number of heaters.

However, increasing an ink jet recording apparatus in the number of heaters cannot avoid increasing in size the substrate of the recording head chip of the apparatus, provided that the heater pitch on the substrate is kept the same. Besides, in order to increase a recording head chip in size, it must be increased in the size of its substrate. As the substrate is increased in size, it becomes more nonuniform in thickness, at microscopic level, because of the reasons attributable to the chip manufacturing process, for example, the nonuniformity in the thickness of a silicon wafer from which the substrate is cut. Therefore, it is possible that the heaters of the same recording head chip may be different in resistance value. Therefore, if all the heaters of a recording head chip are the same in the width of the heat generation pulse signal supplied thereto to jet ink, some heaters may fail to generate the sufficient amount of energy for ejecting an ink droplet of the proper size, being therefore smaller in the size of the ink droplet they jet by boiling ink, whereas the other heaters may be excessively large in ink droplet size. Therefore, there is a concern that increasing a recording head chip in size will results in the formation of an image, which is nonuniform in density across the areas such as the areas which correspond in position to the ends of the column of heaters.

Thus, the inventors of the present invention studied the following method for reducing an ink jet recording apparatus in the nonuniformity in image density: A recording head chip is provided with multiple input terminals for heat generation pulse signals, and the heaters are divided into multiple groups in terms of the lengthwise direction of the chip (substrate) so that each group of heaters can be driven with heat generation pulse signals which are as close as possible in width to the optimal heater generation pulse signal for the group. Described next is the unpublished background art of the method described above.

FIG. 15 is a schematic drawing of the recording head chip 900 provided with two heat generation pulse signal input terminals, showing the layout thereof.

Referring to FIG. 15, designated by referential symbols 101 and 102 are pulse signal input terminals. Designated by referential symbols 103 and 104 are signal wires through which two different heat generation pulse signals (HE1, HE2) are transmitted from the pulse signal input terminals 101 and 102, respectively, to drive the heater of each heater segment to which the heat generation pulse signals are inputted. Further, designated by a referential symbol 105 is a column of heaters (heater array), and designated by a referential symbol 106 is an ink delivery chamber.

FIG. 16, which corresponds to the recording head chip shown in FIG. 15, is a chart showing the multiple (four) heater segment groups into which the multiple heaters are divided.

The chart in FIG. 16 represents a recording head chip having forty heater segments. Needless to say, the number of heater segments may be greater than 40. Here, "heater segment (recording element)" means a circuit unit which is made up of a heater (resistor), a driver for driving the heater, and a logic circuit for switching the driver. Through the pulse signal input terminals 101 and 102 shown in FIG. 15, the heat generation pulse signals HE1 and HE2 shown in FIG. 16 are inputted, respectively.

FIG. 17 is a schematic drawing of the pattern formed on recording medium by the ink droplets jetted by the heaters of the heater segments 18-21 (Seg No).

In heater driving control such as the above described one, a recording head chip is driven by two types of heat generation pulse signal (different in pulse width) instead of one. Therefore, it is possible for each group of heater segments to be supplied with the more proper of the two types of heat generation signal through the pulse signal input terminal 101 or 102, reducing thereby each group of heater segments in terms of the level of nonuniformity in density at which it forms an image.

There is virtually no difference in resistance value among the heaters (for example, seg 18 and seg 21) in the area (adjacencies of heater segments 18-21) in which two groups of heater segments border with each other, because the heaters are next to each other. Therefore, if the heater in seg 18 is driven by the heat generation pulse signal, the width of which matches the specific area of the substrate, to which seg 18 belongs, whereas the heater in seg 21 is driven by the heat generation pulse signal, the width of which matches the specific area of the substrate, to which seg 21 belongs, it is possible that one of the two heaters will receive the heat generation pulse signals, the width of which is shorter than the desired width, whereas the other heater will receive the heat generation pulse signals, the width of which is wider than the desired width. This may result in the formation of an image which is nonuniform across the area which corresponds in position to the abovementioned area of the recording head chip (substrate) in which the adjacent two heaters, in terms of the lengthwise direction of the substrate, are different in the width of a heat generation pulse signal.

For example, referring to FIG. 17, the top half of the recording area is covered with the recording dots which were effected by the signals HE1, whereas the bottom half is covered with the recording dots which were effected by the signals HE2. That is, the recording area shown in FIG. 17 corresponds to the border line area of the recording head chip, between the two groups of heater segments which are different in the width of the heat generation pulse signals they receive. The bottom half is covered with the recording dots, which were effected by the HE2 signals, being therefore larger in the amount of the jetted ink, whereas the top half was covered with the recording dots which were effected by the HE1 signals, being therefore smaller in the amount of the jetted ink. Therefore, the areas of an image, such as the area shown in FIG. 17, are more conspicuous in terms of the nonuniformity in density. This phenomenon is more conspicuous when an image is formed with the use of a long recording head chip (heater column is long) than when an image is formed with the use of a short recording head chip.

The present invention was made in consideration of the above described unpublished background art, and its primary object is to provide a recording head chip, the heaters of which are driven with optimal heat generation pulse signals, a recording head employing such a recording head chip, and a recording apparatus employing such a recording head.

SUMMARY OF THE INVENTION

According to an aspect of the present invention, there is provided a recording head substrate comprising a plurality of groups of recording elements arranged in arrays; a number, corresponding to a number of said groups, input contacts for receiving driving pulse signals; signal lines for supplying the driving pulse signals to said groups of recording elements from said input contacts, respectively;

wherein in a region between two of said groups of recording elements are adjacent to each other, said signal lines are connected to said recording elements such that areas in which said groups of recording elements are disposed, respectively, have respective driving pulse signal change areas which are overlapped with each other.

These and other objects, features, and advantages of the present invention will become more apparent upon consideration of the following description of the preferred embodiments of the present invention, taken in conjunction with the accompanying drawings.

BRIEF DESCRIPTION OF DRAWINGS

FIGS. 9(*a*)-9(*c*) are charts showing examples, other than the one shown in FIG. 7, of the relationship between each heater segment of a recording head chip, and the two types of heat generation pulse signal different in width, in the areas of the recording head chip, in which two groups of heater segments border each other.

DETAILED DESCRIPTION OF THE PREFERRED EMBODIMENTS

Hereinafter, one of the preferred embodiments of the present invention will be more concretely described in detail, with reference to the appended drawings.

Incidentally, in this specification, "record" (which may sometimes referred to as "print") does not always means to present information in a concrete form, such as a character, a picture, etc., which has a concrete meaning. That is, it means to form any pattern on recording medium. In other words, it does not matter whether or not the pattern has a specific meaning, or the pattern is visually detectable. It also includes processing recording medium.

Further, "recording medium" does not strictly means ordinary paper used by a recording apparatus. It includes a wide range of recording media, for example, fabric, plastic film, metallic plate, glass, ceramic, lumber, leather, etc. In other words, it includes anything capable of accepting ink.

Further, the meaning of "ink" (which sometimes may be referred to as "liquid") should also be loosely interpreted. That is, in this specification, "ink" means any liquid which can be used for forming a pattern on recording medium, processing recording medium, or processing ink (that is, for solidifying, or make insoluble, colorant in ink deposited on recording media).

Further, "nozzle" means the entirety which includes an orifice, a liquid passage leading to the orifice, and an element for generating the energy to be used for jetting ink, unless specifically noted.

<General Description of Apparatus Main Assembly>

Figure 1:
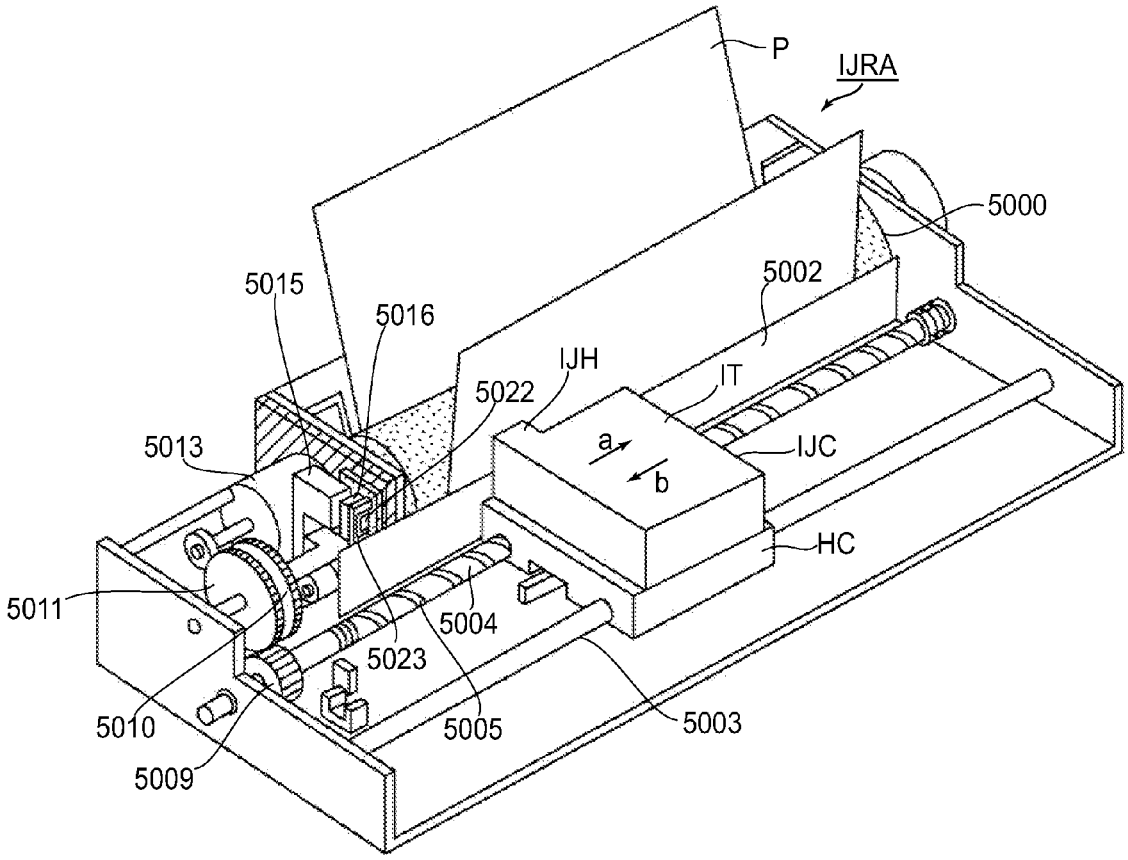
FIG. 1 is an external perspective view of a typical ink jet recording apparatus, to which the present invention is applicable, showing the general structure thereof.

FIG. 1 is an external perspective view of the ink jet recording apparatus IJRA (which hereafter may be referred to as recording apparatus) in a typical embodiment of the present invention, showing the general structure thereof.

Referring to FIG. 1, a carriage HC, which is engaged with the spiral groove 5004 of a lead screw 5005, which is rotated forward or backward by the forward or backward rotation of a motor 5013, through driving force transmission gears 5009-5011, has a pin (unshown). The carriage HC is supported by a guide rail 5005, and is reciprocally movable in the directions indicated by arrow marks a and b. On the carriage HC, a single-piece ink jet cartridge IJC made up of a recording head IJH and an ink container IT, which are integrally joined is mounted. Designated by a referential symbol 5002 is a paper pressing plate, which keeps a recording medium P pressed upon a platen 5000, across the entire moving range of the carriage HC. Designated by a referential symbol 5016 is a member which supports a capping member 5022 for capping the front surface of the recording head IJH, and designated by a referential symbol 5015 is a suctioning device for suctioning the interior of the capping member 5022 to restore in performance the recording head by suctioning the recording head through the internal cavity of the capping member 5022.

<Description of Control Circuit Structure>

Next, the structure of the control circuit for controlling the above described apparatus will be described.

Figure 2:
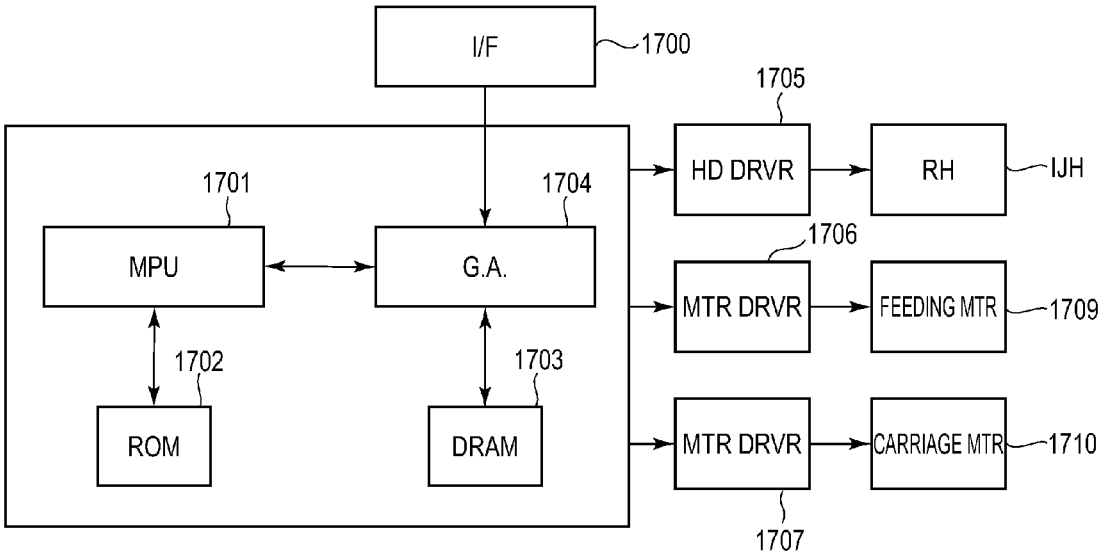
FIG. 2 is a block diagram of the control circuit of a recording apparatus IJRA, showing the configuration thereof.

FIG. 2 is a block diagram of the control of the recording apparatus IJRA, showing the structure thereof.

Referring to FIG. 2, designated by a referential symbol 1700 is an interface through which recording signals are inputted; 1701, MPU; 1702, a ROM in which control programs which the MPU 1701 carries out are stored; 1703, a DRAM in which various data (recording signals, recording data to be supplied to recording head, etc.); 1704, a gate array (G. A.) which controls the transmission of recording data to the recording head IJH, and also, the transmission of data between the interface 1700 and MPU 1701 and between the MPU 1701 and RAM 1703; 1710, a carriage motor for moving the recording head IJH; 1709, a motor for conveying recording medium; 1705, a heater driver which drives recording head IJH; and designated by referential symbols 1706 and 1707 are motor drivers which drive the recording medium conveyance motors 1709 and carriage motor 1710, respectively. The heat generation pulse signals, which will be described later, are supplied from the apparatus main assembly to the head through the head driver 1705.

To describe the operation of the above described control system, as recording signals are inputted into the interface 1700, the recording signals are converted into recording data between the gate array 1704 and MPU 1701. Then, the motor drivers 1706 and 1707 are driven, and the recording head IJH is driven in accordance with the recording data sent to the head driver 1705. As a result, an image is recorded.

Figure 3:
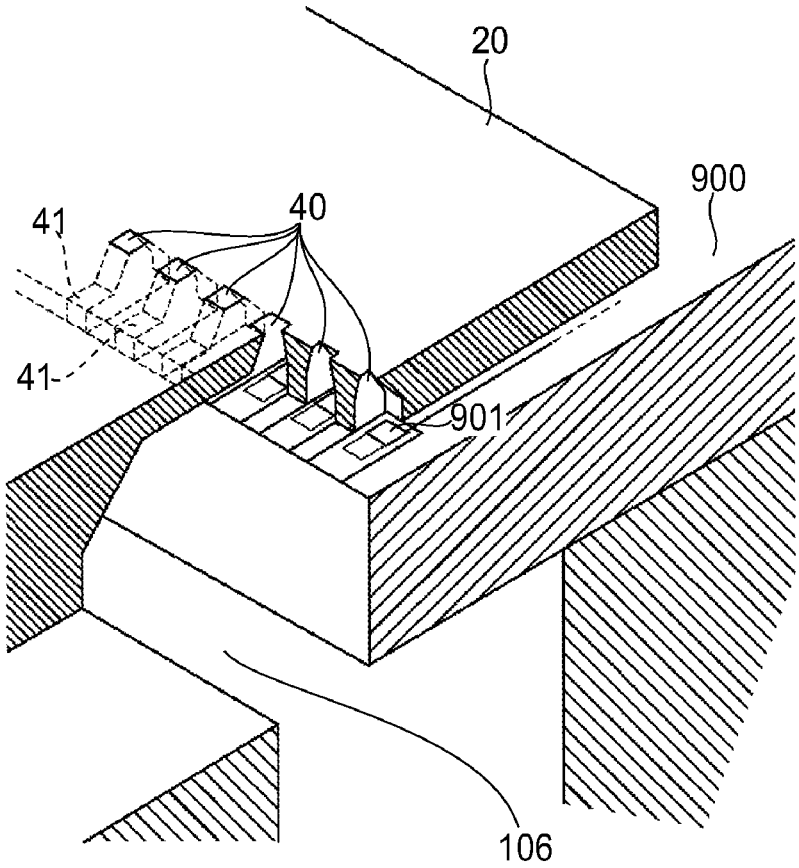
FIG. 3 a partially broken perspective view of the recording head, showing the structure thereof.

FIG. 3 is a partially broken perspective view of the recording head, showing the structure thereof.

Referring to FIG. 3, only some of the heaters 901 (heating resistors) in the heater bank on one side of the ink delivery chamber 106, and the ink jetting nozzles 40 corresponding to the heaters 901, one for one, are shown.

The recording head chip 900 has multiple heaters 901, which generate heat as they receive an electrical signal. The heat generated by each heater 901 generates bubbles, which jet ink from the ink jetting nozzles 40. The heaters 901 are arranged in a single column. The ink jetting nozzles 40 oppose the heaters 901, one for one, and are connected to ink passages 41, one for one, which supply the ink jetting nozzles 40 with ink. These ink jetting nozzles 40 are formed in an orifice plate 20. As the orifice plate 20 is joined with the substrate of the recording head chip 900, a common liquid chamber is formed, which is connected to ink delivery chamber 106 and supplies each ink passage 41 with ink.

Figure 4:
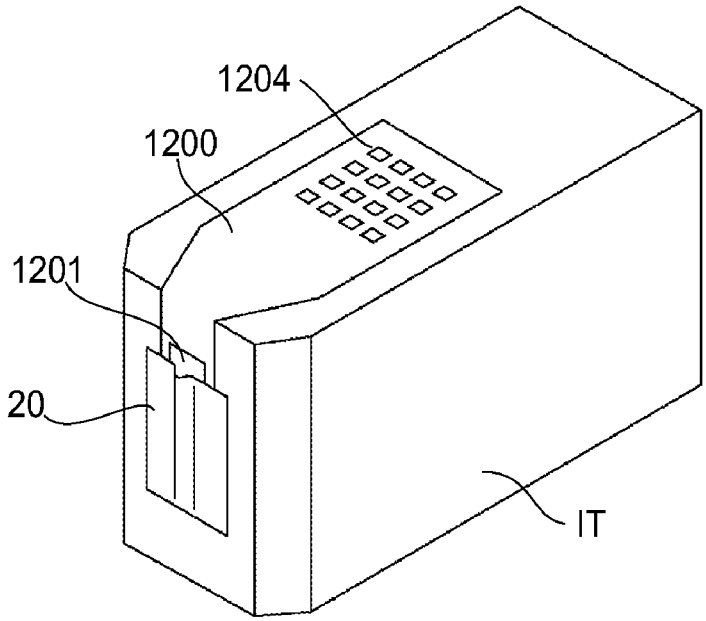
FIG. 4 is an external perspective view of an ink jet cartridge IJC.

FIG. 4 is an external perspective view of the ink jet cartridge IJC.

Referring to FIG. 4, the recording head chip 900 and an electrical contact 1201 are placed on a TAB tape 1200. To one of the lengthwise ends of the TAB tape 1200, a contact pad 1204 is attached, which is for making electrical connection between the recording head chip 900 and the main assembly of the recording apparatus. In this embodiment, the recording head chip 900 is located on the under side of the orifice plate 20. The orifice plate 20 is pasted to the substrate of the recording head chip 900 after the formation of the liquid passages 41 on the substrate of the recording head chip 900 using dry film or the like. Then, the recording head chip 900 is pasted to the ink container IT to which the TAB tape has been pasted. Then, a bonding process is carried out. Then, the electrical contact 1201 of the TAB tape 1200 is sealed by a sealing member, yielding the ink jet cartridge IJC. Incidentally, the ink jet cartridge IJC may be structured so that its recording head IJH and ink container are separable.

Figure 5:
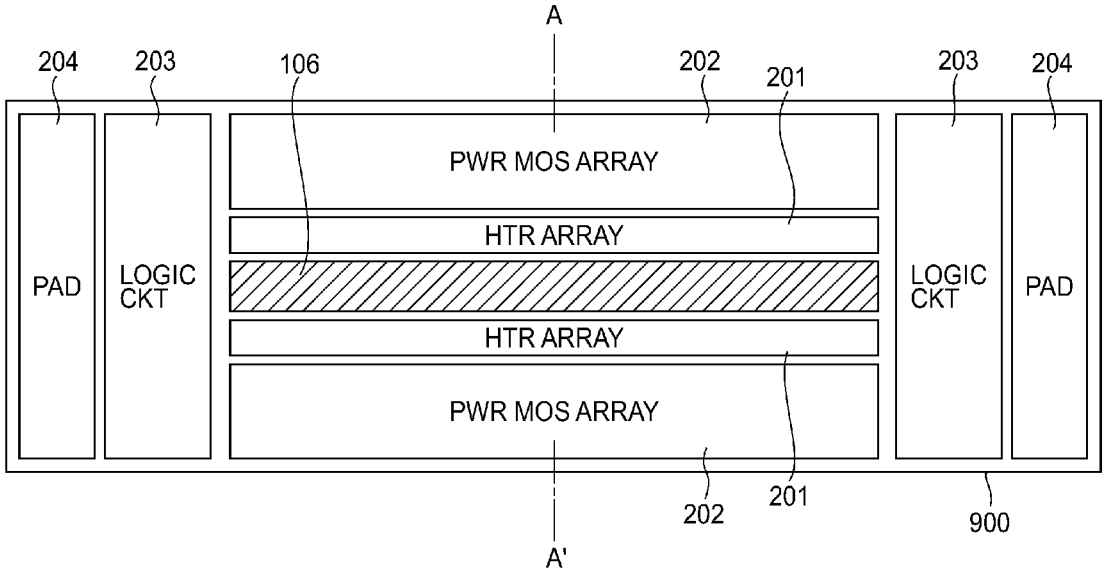
FIG. 5 is a schematic drawing of a recording head chip, showing the structure thereof.

FIG. 5 is a schematic drawing of the recording head chip 900, showing the layout of the various elements of the recording head chip 900.

Referring to FIG. 5, a heater array 201 is made up of multiple heaters (unshown), which are heat generating resistors for supplying thermal energy to be used for jetting ink. A power MOS array 202 is made up of multiple power MOS transistors (unshown) for selectively supplying the heaters with electrical current. Each of these heaters and driver transistors is one of the elements which make up a recording element.

A logic circuit 203 is a circuit (unshown) for controlling the switching operation of the transistor of each driver. A pad 204 is for making electrical connection between the recording head chip and the main assembly of the recording apparatus. Further, the ink delivery chamber 106 is provided for delivering ink from the ink container (unshown) located on the back side of the recording head chip 900 to the position of each heater 901 located on the front surface of the substrate of the recording head chip 900.

Figure 14:
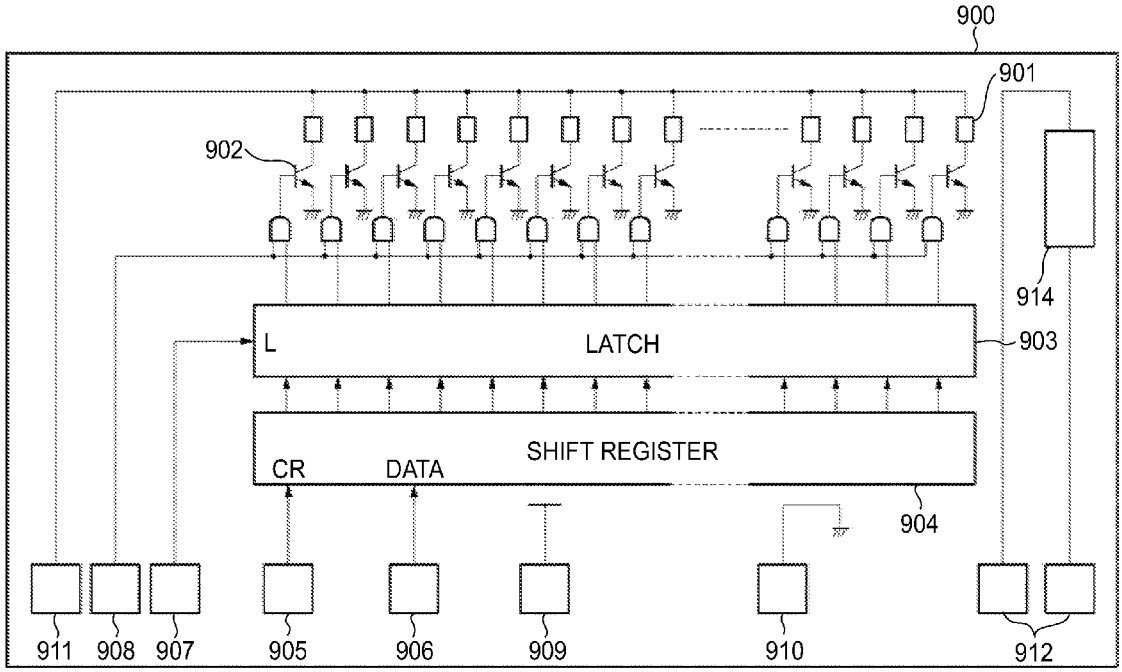
FIG. 14 is a block diagram of a recording head chip in accordance with the prior art, showing the electrical circuit design thereof.

The details of the structure of each of the abovementioned structural elements shown in FIG. 5 are the same as those of the recording head chip in accordance with the prior art, which was described above referring to FIG. 14, and therefore, will not be described; they will be described referring to the structural elements, shown in FIG. 14, referring to the referential symbols which designate corresponding elements. Incidentally, the details of the structural elements (designated by referential symbols 901, 902, 903, 904, and 905-912), shown in FIG. 14, correspond to the heater array 201 and power MOS array 202 on the top (or bottom) half of the recording head chip shown in FIG. 5, and of the logic circuit 203 and pad 204 on the right (or left) half of the recording head chip shown in FIG. 5.

Further, the recording head chip 900 is provided with various sensors, such as the above described rank heater (unshown), which are formed on the substrate of the recording head chip 900. A rank heater is formed using the same steps as the steps for forming heaters 901, that is, the step for forming film on the substrate of the recording head chip 900, the step for etching the substrate, etc., and its resistance value is measured. The measured rank heater resistance is used to adjust in voltage and/or width a heat generation pulse signal, in order to compensate for the nonuniformity in the resistance value among the heaters of each recording head chip, and the nonuniformity of the surface of the silicon substrate of each recording head chip, which occurred while a recording head chip was manufactured. Incidentally, in this embodiment, the heat generation pulse signals (heater driving pulse signals) supplied from the main assembly of the recording apparatus to drive the recording head chip 900 are controlled in pulse width while being kept constant in voltage.

Further, in order to minimize the effects of the nonuniformity in the heater size and/or like which is attributable to the nonuniformity in the patterns and manufacture processes, it is desired that the recording head chip is provided with multiple rank heaters which are identical in structure and size so that the average value of their resistance can be used. Further, the extent of nonuniformity among the multiple heater segments, and the extent of nonuniformity of the surface of the silicon substrate, can be detected by placing multiple rank heaters in the multiple heater segment groups, one for one, into which the heater segments of the recording head chip are divided in accordance with the number of the input terminals through which multiple types of heat generation pulse signal, which are different in width, are inputted, one for one. With the employment of this arrangement, it is possible to more precisely detect the extent of the abovementioned nonuniformity, regardless of recording head chip size.

Next, the wiring of the essential portions of the recording head chip 900 in this embodiment will be described.

Figure 6:
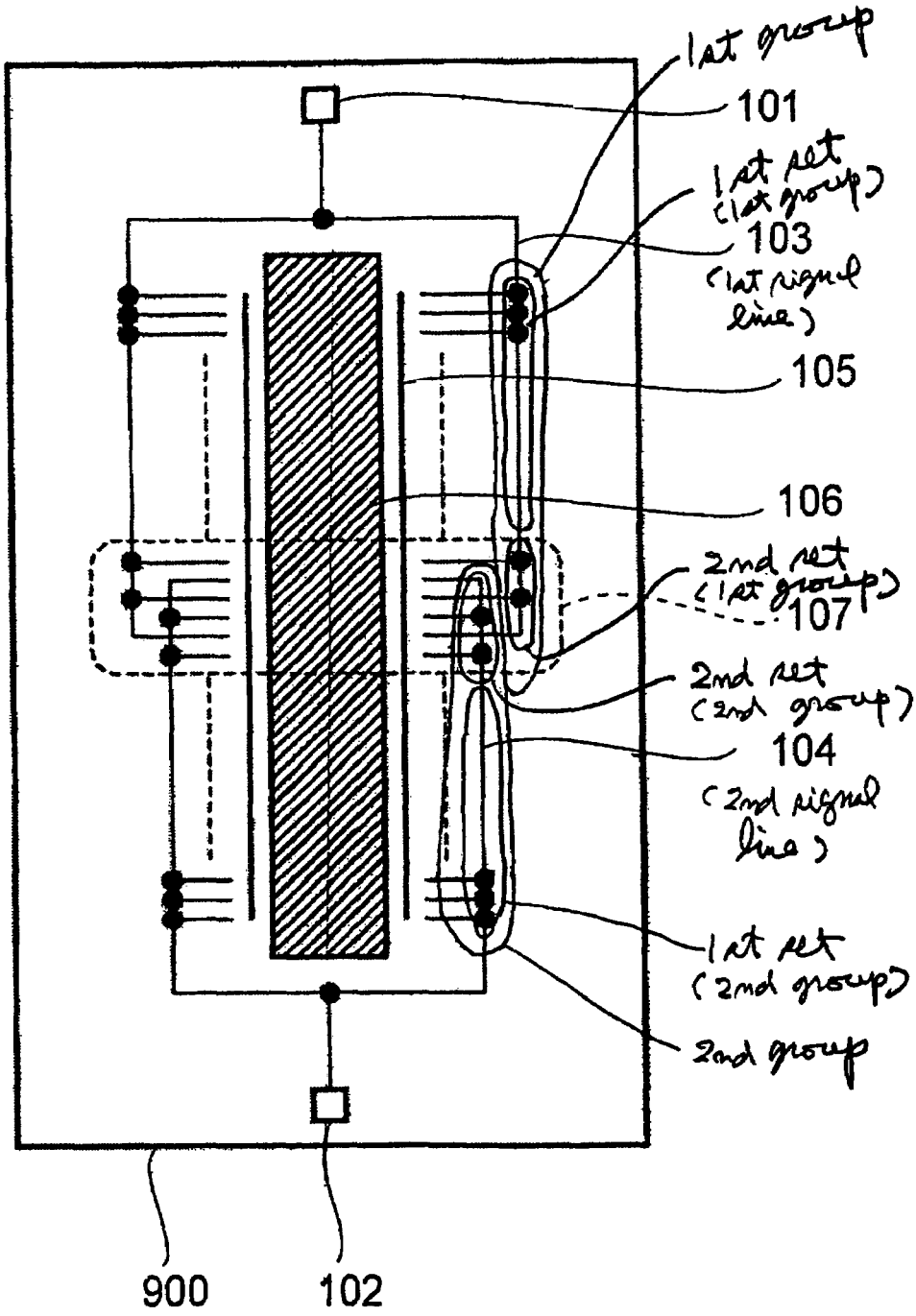
FIG. 6 is a schematic drawing of a recording head chip, showing the layout thereof.

FIG. 6 is a schematic drawing of the recording head chip in this embodiment, showing the general wiring thereof.

Figure 15:
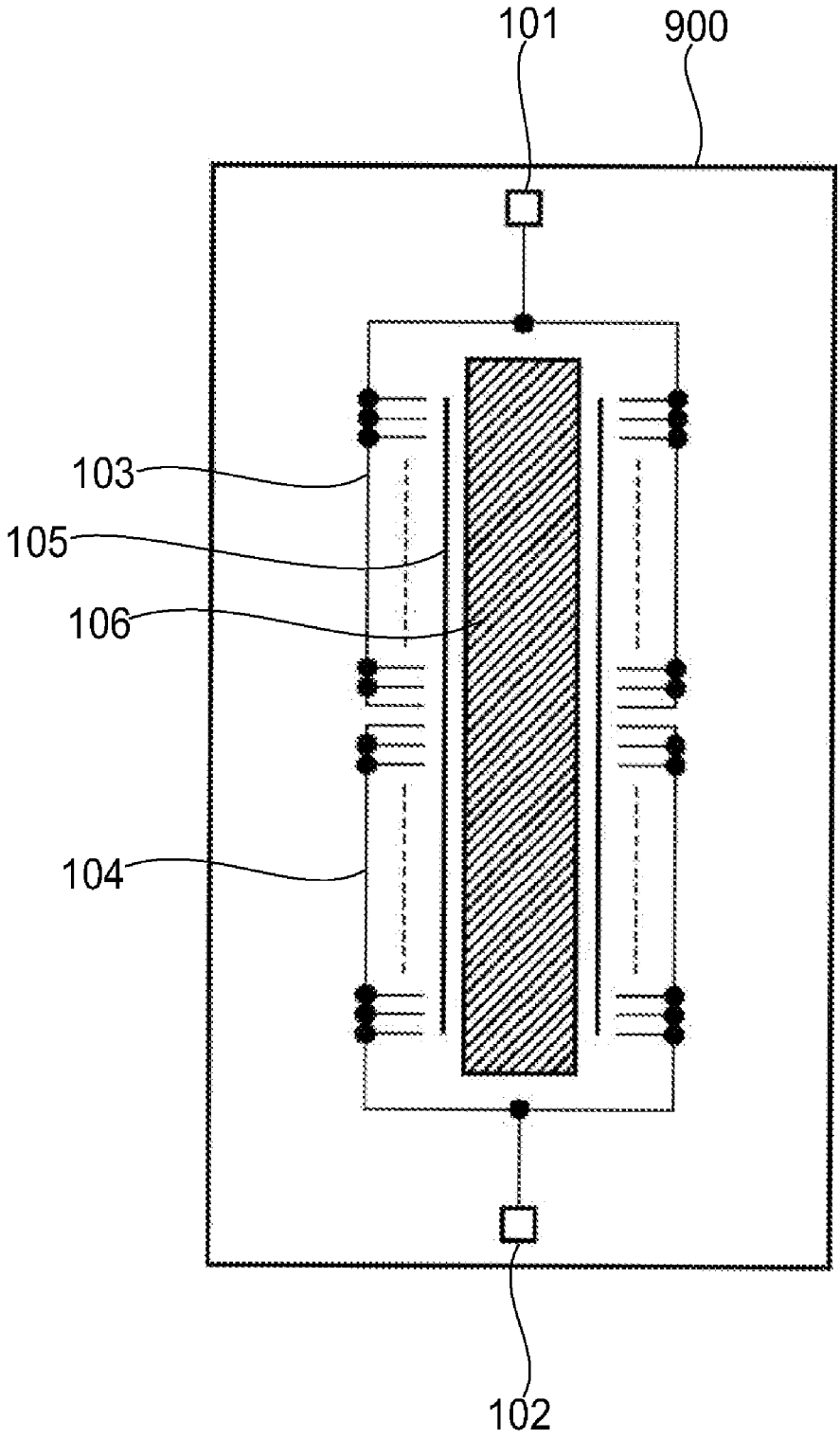
FIG. 15 is a schematic drawing of the recording head chip provided with two heat generation pulse signal input terminals, showing the layout thereof.

Incidentally, the structural elements in FIG. 6, which are identical to those in FIG. 15, are given the same referential symbols as those given to the counterparts in FIG. 15, and will not be described here.

As will be evident from the comparison between FIGS. 6 and 15, in the case of the recording head chip shown in FIG. 15, the heat generation pulse signals (HE1 and HE2) inputted through the pulse signal input terminals 101 and 102, respectively, are supplied to the heater segment groups (recording element groups) of the top and bottom halves, respectively, of the recording head chip 900. That is, the heater segments zero to 18 on the left heater column, and the heater segments one to 19 on the right heater column, make up the top groups, whereas the heater segments from 20 to 38 on the left heater column, and the heater segments 21 to 39, make up the bottom groups, with the presence of a clear distinction, in terms of the width of a heat generation pulse signal, between the top and bottom groups. In comparison, in the case of the recording head chip in this embodiment, the signal wires 103 and 104 are cross connected so that in the area 107 in which two heater segment groups border each other, two heater segments, which are different in the heat generation pulse signal they receive, are alternately positioned in terms of the lengthwise direction of the recording medium chip; the heater segments 18 and 19 receive the heat generation pulse signal HE2, whereas the heater segments 20 and 21 receive the heat generation signal HE1.

Figure 7:
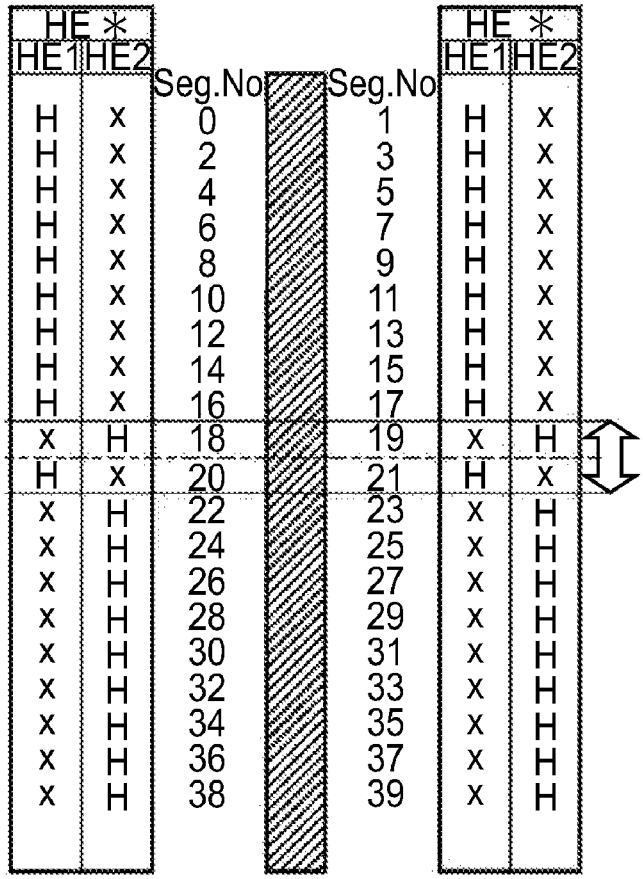
FIG. 7 is a chart showing the relationship between each heater segment of the recording head chip, and the heat generation pulse signal it receives when the recording head chip is wired as shown in FIG. 6.
Figures 16, 17:
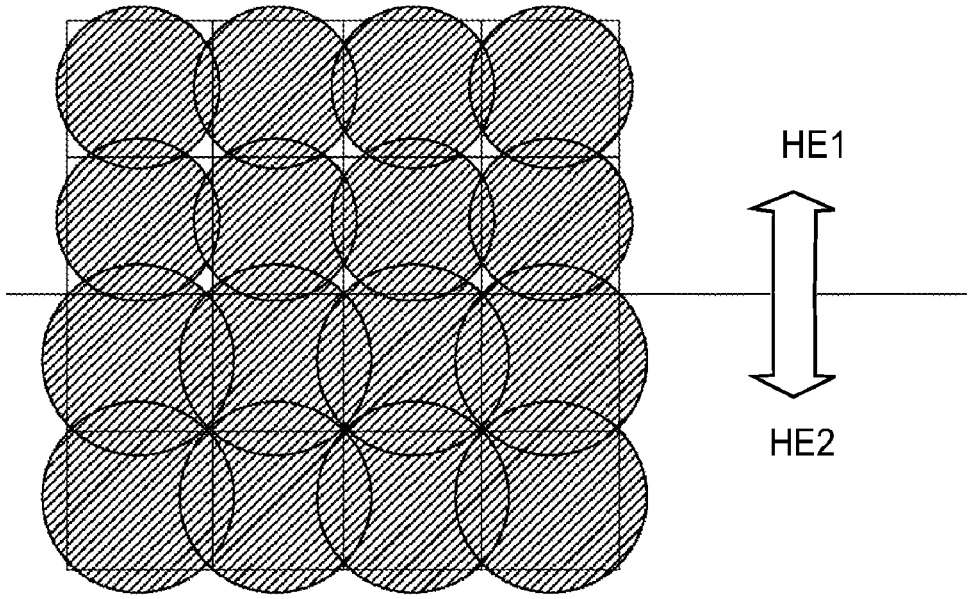
FIG. 16, which corresponds to FIG. 15, is a chart showing the relationship between each heater segment of the recording head chip, and the heat generation pulse signal it receives.
FIG. 17 is a schematic drawing of the area of an image, which is covered with the dots formed by ink droplets jetted from the area of the recording head chip, in which the heater segment group to which the heater segments 18 and 19 belong, and the heater segment group to which heater segments 20 and 21 belong, border each other.

FIG. 7 is a chart showing the relationship between each heater segment of a recording head chip, and the type of heat generation pulse signal it receive, when the recording head chip is wired as shown in FIG. 6. Incidentally, also in the case of the recording head chip shown in FIG. 7, it is assumed that the segment count is 40 as it is in the case of the recording head chip in accordance with the prior art as shown in FIG. 16.

Referring to FIG. 7, most of the heater segments of the top half group are connected to the input terminals 101 for supplying the heat generation pulse signals HE1, and most of the heater segments of the bottom half group are connected to the input terminals 102 for supplying the heat generation pulse signals HE2. However, in the area 107 of the recording head chip 900, shown in FIG. 6, which corresponds to the area indicated by an arrow mark in FIG. 7, the signal wires 103 and 104 for transmitting the signals HE1 and HE2, respectively, are cross connected.

Figure 8:
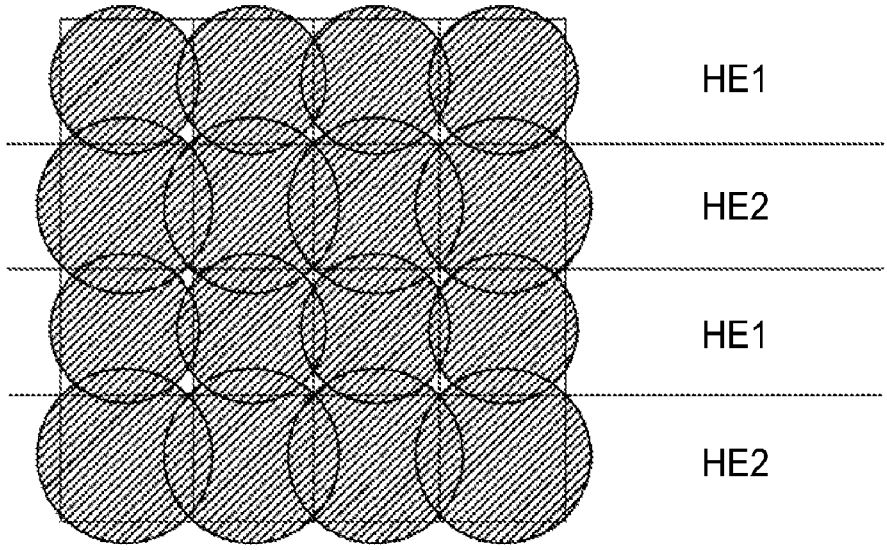
FIG. 8 is a schematic drawing showing the dot-covered area of an image, which was formed with the use of a recording head chip, which had been modified in the relationship between each heater segment, and the heat generation pulse signal it receives, as shown in FIG. 7.

FIG. 8 is a schematic drawing of the recording dots recorded using the recording head chip 900, the signal wires 103 and 104 of which are cross connected in the abovementioned area of the recording head chip.

In the case of the recording dots shown in FIG. 8, they are recorded by the area of the recording head chip, in which a heater segment which is to receive the signal HE1 which is optimal for one of the two groups into which the multiple heater segments are divided to compensate for the nonuniformity in resistance value among the heaters, and a heater segment which is to receive the signal HE2 which is optimal for the other group, are alternately positioned in terms of the heater arrangement direction.

Also referring to FIG. 8, the dots effected by the signal HE2 supplied to the heaters in the center portion of the recording head chip are slightly smaller, because the pulse signal HE2 is slightly smaller in width, and therefore, the ink droplet jetted by the pulse signal HE2 is slightly smaller, whereas the dots effected by the signal HE1 supplied to the heaters in the center portion of the recording head chip are slightly larger, because the pulse signal HE1 is slightly greater in width, and therefore, the ink droplet jetted by the pulse signal HE1 is slightly larger. Obviously, reverse is possible.

In this embodiment, as described above, the signal wires 103 and 104 for transmitting the heat generation pulse signals HE1 and HE2, respectively, are cross connected in the area 107, which hereafter may be referred to as heater driving pulse signal switching area. With the employment of the above described wiring arrangement, it is possible to reduce an ink jet recording apparatus in terms of the conspicuousness of the nonuniformity in the image density, such as the one shown in FIG. 17, which is effected by the area of the recording head chip, in which a heater segment group which is to be driven with heat generation pulse signals which are slightly smaller in width, and a heater segment group which is to be driven with heat generation pulse signals which are slightly larger in width, border each other.

Incidentally, the manner in which the signal wire for transmitting the heat generation pulse signals HE1 and the signal wire for transmitting the heat generation pulse signal HE2 are crossed, does not need to be limited to the one described above, in which only the adjacent two heater segments are switched in the heat generation pulse signal; other arrangements are possible.

FIG. 9 is a chart showing the other patterns in which the signal wire for transmitting the heat generation pulse signal HE1 and the signal wire for transmitting the heat generation pulse signal HE2 may be crossed.

For example, referring to FIG. 9(*a*), the signal wires may be crossed in the area of the recording head chip, in which two groups of heater segments border each other, so that the two heater segments of one group, which are next to the border between the two groups, receive the optimal heat generation pulse signals for the other group, and the two heater segments of the second group, which are next to the border, receives the optimal heat generation pulse signal for the first group. Further, referring to FIG. 9(*b*), the signal wires may be crossed in the area of recording head chip, which in two groups of heater segments border each other, so that two or more heater segments which are to receive one of the two types of heat generation pulse signal, and two or more heater segments which are to receive the other type of heat generation pulse signal, are alternately positioned. Further, the signal wires may be crossed so that the heater segment sub-groups, made up of a preset number of heater segments, which are to receive one of the two types of heater generation pulse signal, and the heater segment sub-groups, made up of a preset number of heater segments, which are to receive the other type of heat generation pulse signal, are alternately positioned.

Further, referring to FIG. 9(*c*), the number of the heat generation pulse signal input terminals may be increased (for example, four), so that the heater segments may be divided into a greater number (for example, four) of groups, the number of which matches the number of the heat generation pulse signal input terminals, and so that the signal wires are crossed in every area of the recording head chip, in which two heater segment groups border each other.

Incidentally, in the above described cases (shown in FIGS. 9(*a*) and 9(*b*)), it is possible that the number of the heater segments in the area (abovementioned heat generation signal switching area) in which the heater segments different in the type of heat generation pulse signal they receive are alternately positioned, will become greater than half the number of heater segments in each of the groups into which the heater segments of a recording head chip are divided to drive each heater segment with an optimal heat generation pulse signal. If this happens, it is possible that the average resistance value of the heaters, in the abovementioned area in which two groups of heater segments border each other, will substantially deviate from the center heater resistance value of each of the two groups, which may result in the formation of an image which is nonuniform in density. Therefore, the number of the heater segments in each of the adjacent two groups of heater segments, which are switched in heat generation pulse signal width, must be set to be no more than half the number of the heater segments in each group (for example, heater segments between heater segments 502 and 504, in FIG. 12 which will be described later).

Next, the feedback process in which the heat generation pulse signals to be inputted through the heat generation pulse input terminals are adjusted in width based on the output values of the rank heater monitor will be described.

Figure 10:
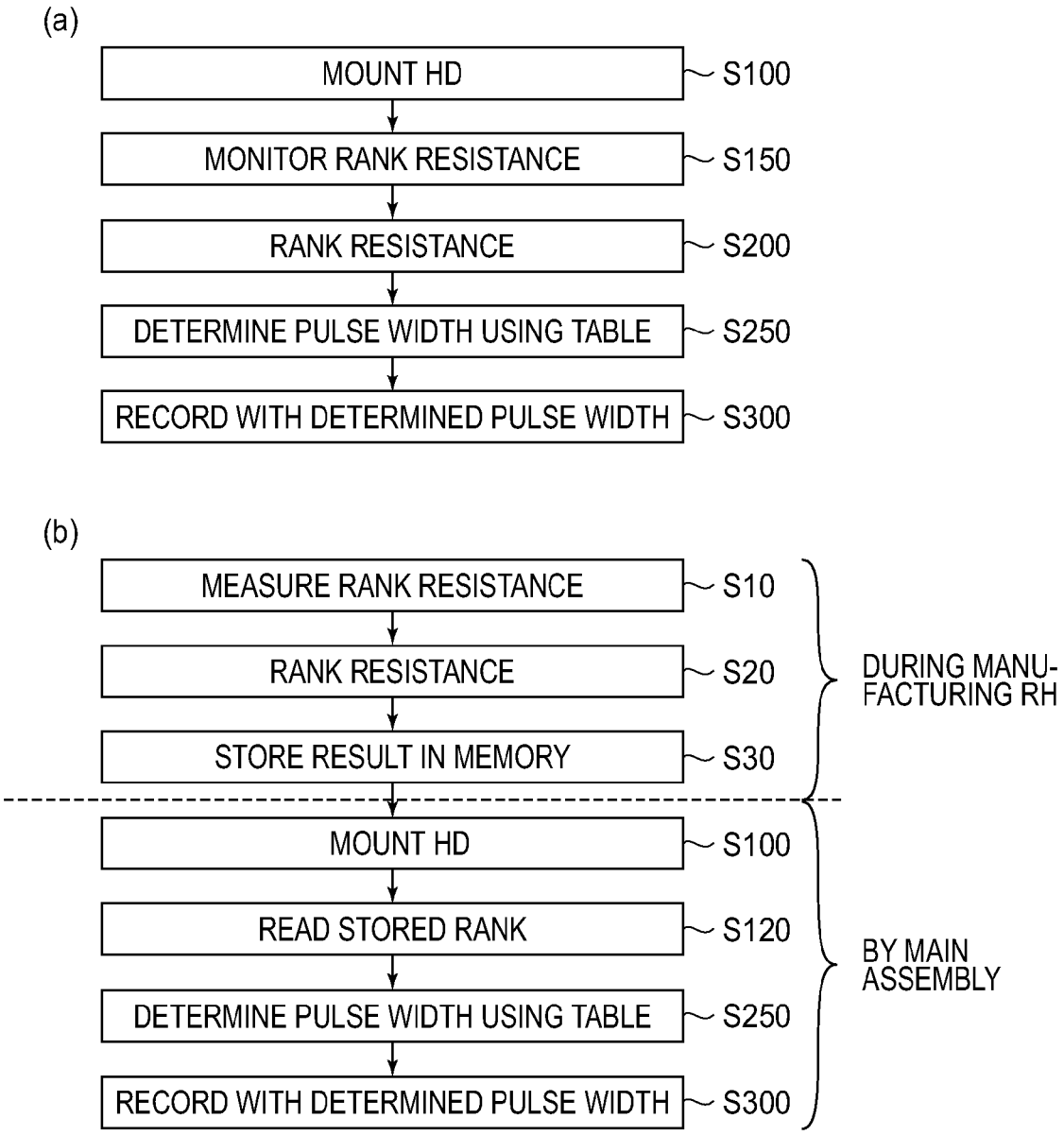
FIG. 10 is a flowchart of the feedback process for controlling the width of a heat generation pulse signal.

FIG. 10 is a flowchart of the feedback process. FIG. 10 shows two types of feedback process. First, the process shown in FIG. 10(*a*) will be described. This process is a process which is carried out only by the recording apparatus.

First, in Step S100, the recording head IJH is mounted into the recording apparatus main assembly. Next, in Step S150, rank heater resistance values are detected under preset conditions. In Step 200, the obtained resistance values are ranked with reference to a ranking table stored in the recording apparatus main assembly, and are numbered according to the ranking.

Figures 11, 12:
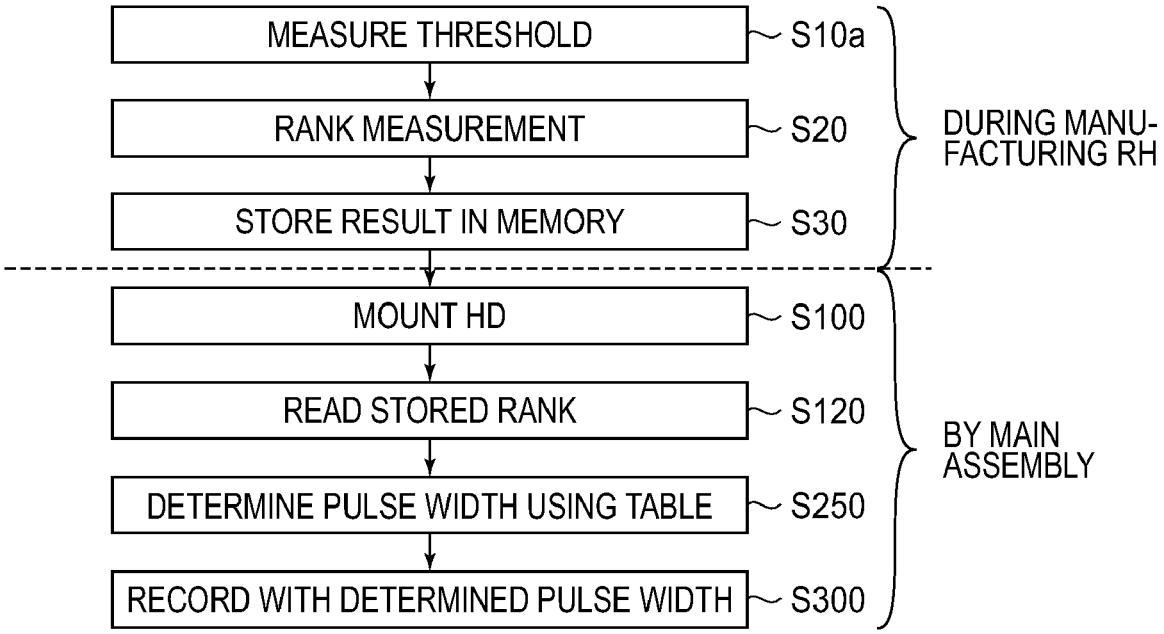
FIG. 11 is a ranking table used for the feedback process.
FIG. 12 is a flowchart of the process for selecting an optimal width for the heat generation pulse signal, from the standpoint of the stability in the ink jetting performance of a recording head chip.

FIG. 11 is a ranking table. According to this table, the preset rank resistor value ranges ($R1 \leqq R \leqq R2$) are divided into N portions which are equal in size, and each portion is given a rank number (No). The obtained rank resistor values are sorted with reference to this table, and are given a ranking number.

In Step S250, the width of the heater driving pulse signal is set using a conversion table for determining the driving condition (pulse width), based on the ranking numbers assigned through the above described ranking process. In Step S300, the recording head IJH is driven under the driving condition set in Step S250 to record an image.

On the other hand, the driving condition may be set according to the rank heater resistance values measured under preset conditions during the manufacture of the recording head, as shown in FIG. 10(*b*). Incidentally, the steps in FIG. 10(*b*), which are the same as the steps in FIG. 10(*a*), are designated by the same referential symbols as those given to the counterparts in FIG. 10(*a*).

That is, in Step S10, the rank heater resistance values are measured under preset conditions during the manufacture of the recording head. In Step S20, the obtained rank heater resistance values are ranked with reference to a table such as the one shown in FIG. 11. Further, in Step S30, the relationship between the optimal amount by which energy is to be supplied to each group of heater segments, and the numerical ranking (ranking number) are stored as recording characteristic information in the internal memory of the recording head.

Thereafter, the recording head is shipped out. Then, the recording head is mounted into the recording apparatus main assembly, in Step S10, as described above.

In Step S120, the information regarding each recording head (rank number), which is in the memory of each recording head, is read. Then, the Step 250 and Step 300 are carried out as described with reference to FIG. 10(*b*).

The rank heater resistance values obtained through the above described steps are used to set the width of the heat generation pulse signals.

Incidentally, the width of a heat generation pulse signal may be adjusted based on the level of stability at which ink is actually jetted, instead of the rank heater resistance values.

FIG. 12 is a flowchart of the process for determining the proper width for a heat generation pulse signal, based on the level of stability at which ink is jetted. Incidentally, the steps in FIG. 12, which are identical to the steps in the flowchart shown in FIG. 10(*b*), are given the same referential symbols as those given to the counterparts in FIG. 10(*b*), and will not be described here.

Referring to FIG. 12, in Step S10*a*, the level of stability at which ink is jetted (threshold value for jetting of ink) is measured instead of the rank heater resistance values. Then, the rank number is obtained based on the information regarding the obtained level of stability at which ink is jetted. Then, the steps similar to those described with reference to FIG. 10(*b*) are carried out.

In order to increase the number of heater segments, a recording head chip must be increased in size, which in turn makes the heaters of the recording head chip more nonuniform in electrical resistance value. That is, the nonuniformity of the surface of the substrate of a recording head chip, the nonuniformity in the recording head chip manufacturing operations (processes), and/or the like, results in the formation of recording head chips different in heater resistance value distribution.

Therefore, in order to drive the heater in each of the preset number of groups into which the multiple heaters have been divided, with heat generation pulse signals which are optimal for the group, it is desired that the recording head chip is provided with multiple rank heaters, the number of which matches that of the heat generation pulse signal input terminals, so that the rank heater resistance value can be measured for each group of heater segments. Further, in order to ensure that the resistance value of each rank heater accurately represents the resistance value of the heaters in each group, the rank heater of each group is disposed in the center of each group of heaters, and, the thus obtained rank heater resistance value is feed back.

Figure 13:
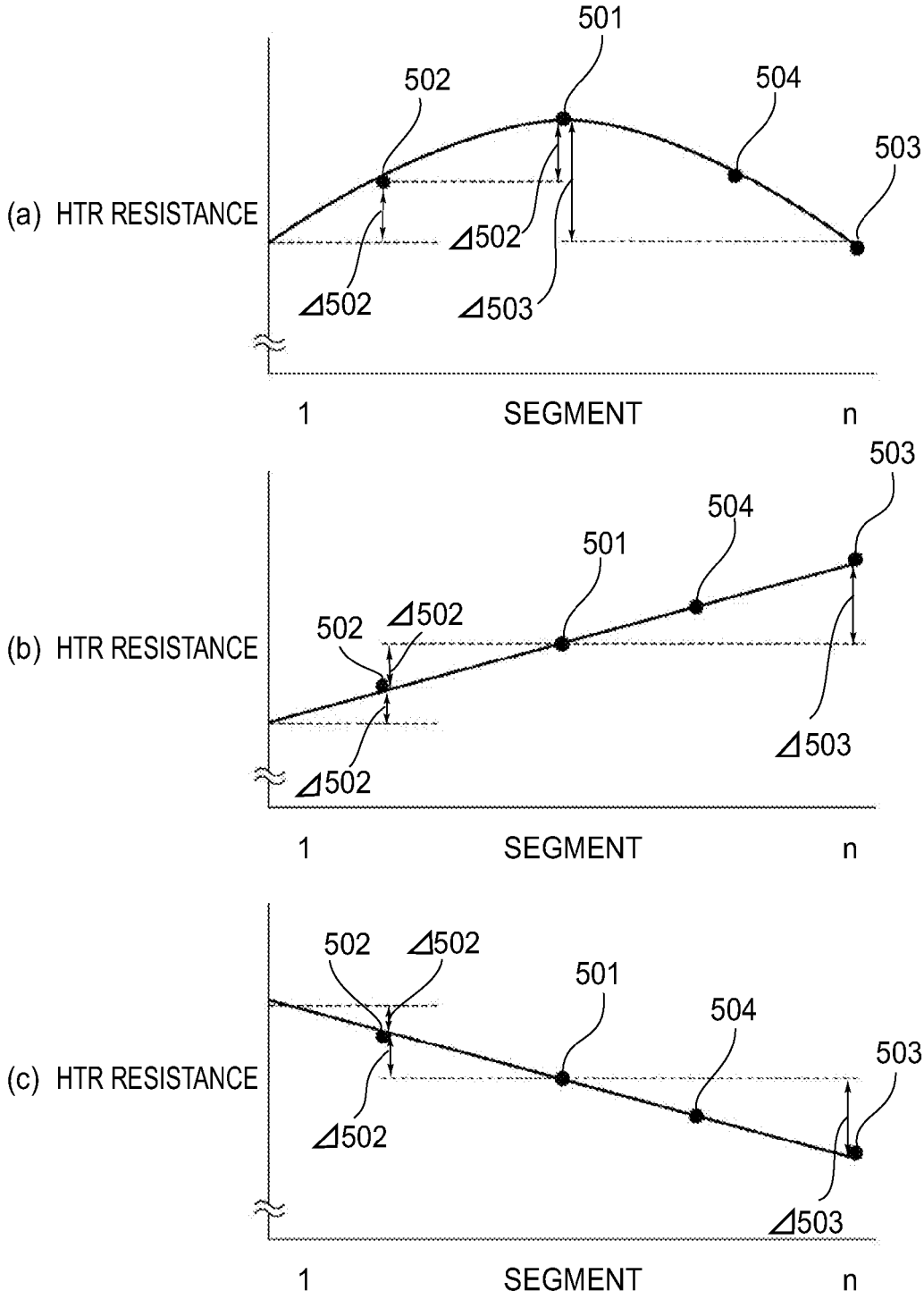
FIGS. 13(*a*)-13(*c*) are schematic drawings showing three types of heater resistance value deviation, one for one.

FIG. 13 is a chart showing the nonuniformity in terms of the electrical resistance value among the heaters in each group. Here, FIG. 13 presents three cases of the nonuniformity (deviation in resistance value). In FIG. 13, the vertical axis represents the resistance value of a heater, and the horizontal axis represents the numerical name of a heater, and the location thereof.

First, referring to FIG. 13(*a*), the case in which a recording head chip is provided with two heat generation pulse signal input terminals, and the heater segments of the chip are divided into two groups, that is, left-hand group which includes the heater segment 501 and those on the left-hand side thereof, and the right-hand group, or the group on the right-hand side of the heater segment 501 (excluding the heater segment 501), will be discussed. In this case, the rank heater is disposed in the adjacencies of the heater segment 501, 502, or 503.

In this case, the left-hand side means the left-hand side in terms of the lengthwise direction of the substrate of the recording head chip the side, and the side which is smaller in the heater segment number. The right-hand side means the right-hand side, in terms of the lengthwise direction of the substrate of the recording head chip, and the side which is larger in the heater segment number.

If the rank heater is placed in the adjacencies of the heater segment 501 or 503, the amount of the deviation of the resistance of the farthest heater from the position of the rank heater is Δ503. In comparison, if the rank heater is disposed in the adjacencies of the heater segment 502, the amount of the deviation of the resistance of the farthest heater from the position of the rank heater is Δ502. The value of Δ502 is half of the value of Δ503. Therefore, if the rank heater is disposed in the adjacencies of the heater segment 502 or 504, the amount of the deviation of the heater resistance is estimated to be half the amount which the deviation of the heater resistance will be estimated to be if the rank heater is disposed in the adjacencies of the heater segments 501 or 503.

This is true with the cases shown in FIGS. 13(*b*) and 13(*c*), in which the pattern of the deviation of the heater resistance is linear. That is, if the rank heater is disposed in the adjacencies of the heater segment 501 or 503, the maximum amount of deviation of the heater resistance is Δ305, whereas when the rank heater is disposed in the adjacencies of the heater segment 502, the maximum amount of the deviation of the heater resistance is Δ502. That is, as the rank heater is changed in position as described above, the amount of the deviation of the heater resistance value halves.

Therefore, by providing a recording head chip with the same number of rank heaters as the number of heat generation pulse signal input terminals of the recording head chip, and positioning each rank heater roughly in the center of the corresponding heater segment group, it is possible to minimize the effect of the deviation of the heater resistance upon the width of the heat generation pulse signal.

That is, according to the embodiment of the present invention described above, the recording head chip is provided with multiple heater segments and multiple heat generation pulse signal input terminals. The multiple heater segments are divided into multiple groups, the number of which matches the number of the heat generation pulse signal input terminals, and each group of heater segments is driven by heat generation pulse signals, which are different in width from those which are used for driving the other groups of heater segments. Further, in the border area between the two adjacent groups of heater segments, the signal wires from the heat generation pulse signal input terminal for one of the two groups of heater segments are connected to the heater segments in the other group, and the signal wires from the other terminal are connected to the heater segments in the first group, in such a manner that in the border area, the heater segments which are to receive the heat generation pulses signals from one of the heat generation pulse signal terminals and the heater segments which are to receive the heat generation pulse signals from the other heat generation pulse signal terminal are alternately positioned.

Therefore, in the adjacencies of the border line between the two groups of heater segments, the difference between the two side of the border is less conspicuous in terms of the effects of the difference in the characteristic of a heat generation pulse signal between the two sides. Therefore, it is possible to record an image which is substantially higher in quality than an image formed by an ink jet recording apparatus in accordance with the prior art, in that it is substantially smaller in the degree of the nonuniformity in density attributable to the difference in the ink droplet size between the area of the image, which are formed by the heater segments in the adjacencies of one side of the border line between the two groups of heat segments, and the area of the image formed by the heater segments in the adjacencies of the other side of the border.

Further, each rank heater is disposed roughly in the center of the area on which the corresponding heater segment group (into which heater segments of recording head chip have been divided) is located, and the width of the heat generation pulse signal supplied to this group of heater segments is set according to the rank heater resistance value. Therefore, it is possible to drive each heater in each group of heater segments with a proper amount of energy, making the multiple heater segments of the recording head chip in this embodiment substantially more uniform in ink jetting characteristic than a recording head chip in accordance with the prior art. Thus, this embodiment contributes to the object of forming an image which is much higher in quality than an image formed by an ink jet recording apparatus in accordance with the prior art.

Further, in this embodiment described above, it was assumed that the liquid droplet jetted from the recording head was a liquid ink droplet, and the liquid stored in the ink container was liquid ink. However, the liquid to be stored in the ink container does not need to be liquid ink. For example, liquid such as liquid to be jetted onto recording medium to better fix an image to the recording medium, improve in water resistance the recorded image on the recording medium, and/or improve in quality the recorded image on the recording medium, may be stored in the ink container.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 365424/2005 filed Dec. 19, 2005 which is hereby incorporated by reference.

What is claimed is:

1. A recording head substrate comprising:

first and second groups of recording elements arranged in respective arrays;

first and second input contacts for receiving driving pulse signals;

first and second signal lines for supplying the driving pulse signals to said first and second groups of recording elements from said first and second input contacts, respectively;

wherein said first group of said recording elements includes a first set of recording elements and a second set of recording elements, and said second group of said recording elements includes a first set of recording elements and a second set of recording elements, wherein said recording elements in said first set of said first group are adjacent to each other, and said recording elements in said first set of said second group are adjacent to each other, wherein said recording elements in said second set of said first group and said recording elements in said second set of said second group are disposed alternately, and wherein a number of said recording elements in said second set of said second group is not more than one half a number of recording elements in said first set of said second group.

2. The substrate according to claim 1, further comprising first and second monitor elements for measuring recording properties of said recording elements, wherein said monitor elements are disposed substantially at a central portion of the array of said recording elements included in respective groups.

3. The substrate according to claim 1, wherein each of said recording elements comprises a heater resister and a power transistor for actuating said heater resister.

4. The substrate according to claim 1, further comprising a memory element for storing information indicative of recording properties of said recording elements.

5. A recording head comprising a recording head substrate according to claim 1.

* * * * *